US010392030B2

(12) United States Patent
Natter et al.

(10) Patent No.: US 10,392,030 B2
(45) Date of Patent: Aug. 27, 2019

(54) AERIAL CABLEWAY SYSTEM

(71) Applicant: INNOVA PATENT GMBH, Wolfurt (AT)

(72) Inventors: Andreas Natter, Bildstein (AT); Mario Benzer, Schwarzach (AT)

(73) Assignee: Innova Patent GmbH, Wolfurt (AT)

( * ) Notice: Subject to any disclaimer, the term of this patent is extended or adjusted under 35 U.S.C. 154(b) by 146 days.

(21) Appl. No.: 15/527,869

(22) PCT Filed: Nov. 19, 2015

(86) PCT No.: PCT/AT2015/000146

§ 371 (c)(1),
(2) Date: May 18, 2017

(87) PCT Pub. No.: WO2016/077854

PCT Pub. Date: May 26, 2016

(65) Prior Publication Data

US 2018/0029613 A1 Feb. 1, 2018

(30) Foreign Application Priority Data

Nov. 20, 2014 (AT) ..... 841/2014

(51) Int. Cl.

| | |
|---|---|
| ***B61B 1/02*** | (2006.01) |
| ***B61B 7/00*** | (2006.01) |
| ***B61B 12/00*** | (2006.01) |

(52) U.S. Cl.

CPC ..... *B61B 1/02* (2013.01); *B61B 7/00* (2013.01); *B61B 12/00* (2013.01)

(58) Field of Classification Search

CPC .... B61B 1/00; B61B 1/02; B61B 7/00; B61B 12/00

See application file for complete search history.

(56) References Cited

U.S. PATENT DOCUMENTS

| | | | | |
|---|---|---|---|---|
| 4,662,285 | A * | 5/1987 | Rossignol | B61B 11/004 104/173.2 |
| 5,454,326 | A * | 10/1995 | Goirand | B61B 12/022 104/173.1 |
| 5,626,078 | A * | 5/1997 | Fuchs | B61B 12/022 104/173.1 |
| 8,615,338 | B2 | 12/2013 | Creissels | |
| 2007/0251407 | A1 * | 11/2007 | Gabriel | B61B 1/02 104/180 |

(Continued)

FOREIGN PATENT DOCUMENTS

| | | | |
|---|---|---|---|
| CN | 1903631 | A | 1/2007 |
| EP | 0613808 | A1 | 9/1994 |

(Continued)

*Primary Examiner* — Jason C Smith

(74) *Attorney, Agent, or Firm* — Laurence A. Greenberg; Werner H. Stemer; Ralph E. Locher

(57) ABSTRACT

An aerial cableway system has at least two stations between which vehicles, such as gondola cars, travel as they are pulled by a cable. The stations include a boarding zone for passengers to board the vehicles and a disembarking zone, where passengers disembark from the vehicles. A sensor can be activated by a vehicle entering a station. At least one restricted area with at least one restrictor is located in the station and the restrictor has a controller which can be activated by the sensor.

21 Claims, 2 Drawing Sheets

(56) References Cited

U.S. PATENT DOCUMENTS

| | | | | |
|---|---|---|---|---|
| 2012/0245769 | A1* | 9/2012 | Creissels | B61B 12/022 701/19 |
| 2018/0029613 | A1* | 2/2018 | Natter | B61B 1/02 |

FOREIGN PATENT DOCUMENTS

| | | | |
|---|---|---|---|
| EP | 0736434 | A2 | 10/1996 |
| EP | 1849674 | A1 | 10/2007 |
| FR | 2678571 | A1 | 1/1993 |
| FR | 2769564 | A1 | 4/1999 |
| FR | 2800689 | A1 | 5/2001 |
| JP | 2011032692 | A | 2/2011 |
| JP | 2012508413 | A | 4/2012 |
| WO | 2013144850 | A1 | 10/2013 |

* cited by examiner

AERIAL CABLEWAY SYSTEM

BACKGROUND OF THE INVENTION

Field of the Invention

The invention relates to an aerial cableway system comprising at least two stations between which vehicles, in particular cars, can travel as they are pulled by a cable; the stations include a loading area for passengers to board vehicles and an unloading area for passengers to deboard vehicles.

Aerial cableway systems, for example, gondola lift systems or chairlift systems, comprise an unloading area and a loading area for passengers to be transported, in one station. When a vehicle, such as a car or a chairlift, enters a station, the unloading area is passed through first, followed by the loading area. A redirection area can be provided between the unloading area and the loading area, if necessary, in order to change the direction of travel of the vehicle.

In an aerial cableway system comprising continuously circulating vehicles, the passengers must deboard the vehicles or board these vehicles, in the areas provided therefor, in the stations, while the vehicles continue to move. It must therefore be ensured that it is possible for passengers to deboard and board within the period of time within which the vehicle moves through the unloading area and the loading area.

In the previously known aerial cableway systems having such a design, it can be problematic that an uncertain and essentially uncontrolled number of passengers is located in the loading area. If this number of passengers exceeds the maximum possible number of passengers for a vehicle, uncertainty can arise regarding which passenger can board the vehicle and which passenger must wait for the next vehicle. Consequently, there is the risk, on the one hand, that there will be a big push by the passengers toward a vehicle, which can pose a potential risk to the passengers. On the other hand, this can result in vehicles being under-occupied even when there is a high volume of passengers.

SUMMARY OF THE INVENTION

The problem addressed by the invention is that of providing an aerial cableway system which better coordinates the boarding of passengers into the vehicles.

This problem is solved according to the invention by an aerial cableway system which has the features as claimed.

Preferred and advantageous embodiments of the invention are the subject matter of the dependent claims.

According to the invention, a sensor is provided, which can be activated by a vehicle entering a station, and at least one delimited area situated in the station, which comprises at least one restrictor that includes a controller which can be activated by the sensor. It is therefore possible to avoid an excessive number of passengers in the loading area, to increase the safety in the loading area, and to avoid an under-occupation of the vehicles. In particular, it is clarified as to which passengers can board an approaching vehicle and which cannot.

Within the scope of the invention, "entering a station" means that a vehicle in the area upstream from the station moves toward the station, and that a vehicle moves out of the area upstream from the station into the station, and that a vehicle within the station moves toward the loading area for the passengers.

Within the scope of the invention, the vehicles, which can be pulled by a cable by means of a suspension and/or hauling cable, are preferably cars or chairs of a chairlift, in particular cars. The invention relates, in particular, to detachable lifts, in which the vehicles in the station are decoupled from the hauling cable and are conveyed through the station at a slower speed.

Within the scope of the invention, each of the vehicles can comprise an information transmitter which activates the sensor, or the vehicles can trigger an information transmitter which is situated, in particular, in the area of a station, and activates the sensor.

In order to continue to ensure a sequence of events in the loading area that is as rapid and safe as possible, it is provided in one preferred embodiment that the sensor is situated—as viewed in the direction of travel of the vehicle—upstream from the loading area into the vehicle, for example, is assigned to the area in which a vehicle enters a station.

Advantageously, the controller can comprise a time-switch element, and therefore the restrictor permits passage by a predefined number of individual passengers after a predefined period of time after the activation of the sensor by a vehicle. In order to permit the filling of the delimited area to be controlled in the event of an interference, it is advantageously provided that the period of time can be changed depending on the current speed of the vehicles into and/or through the station.

In order to ensure a sequence of events in the loading area that is as rapid and safe as possible, it is provided in one preferred embodiment that the delimited area is assigned to the loading area, in particular being situated upstream from the loading area.

In one preferred embodiment of the invention, it is provided that a restrictor to enter the delimited area is situated in the access direction, as viewed toward the vehicle, wherein the restrictor to enter the delimited area is preferably a person-separating system, in particular a turnstile. A person-separating system is a device that permits passage by only one individual passenger. Within the scope of the invention, a person-separating system can also be understood to be a non-mechanically acting device, but also an optical display device, as defined in the following.

In yet another preferred embodiment of the invention, it is provided that a restrictor to exit from the delimited area is situated in the access direction, as viewed toward the vehicle.

Within the scope of the invention, the restrictor to exit from the delimited area can be a mechanical barrier and/or a display device which provides information regarding when the passengers are permitted to exit from the delimited area. The barrier, when used as intended, indicates that passengers are permitted to exit from the delimited area, in particular when the vehicle has reached the loading area or is close to reaching the loading area.

The (optical) barrier can be, for example, a display, in particular a screen, on which safety-relevant information is presented. The (optical) barrier can also be a projector which projects, for example, "STOP" or "GO" or the like onto a surface that is visible to passengers located in the delimited area. The safety device can also be a passage provided with a traffic light system, for example in the form of illuminated bars, wherein the color "red" means that the delimited area may not yet be exited, and the color "green" means that the delimited area may be exited. If necessary, the color "yellow" can be used, which can mean that the passengers may exit the delimited area soon.

Barriers can be provided at the sides of the delimited area, and therefore a clearly defined area is formed, which cannot be improperly entered. The size of this delimited area is preferably designed for the maximum number of passengers for a vehicle.

In one preferred embodiment of the invention, it is provided that the sensor activates the controller of the restrictor to exit from the delimited area, and the restrictor to enter the delimited area can be activated by the controller of the restrictor to exit from the delimited area.

Alternatively thereto, it can be provided that the restrictor to enter the delimited area can be activated by one further sensor which can be controlled by a vehicle entering the loading area, or by one further time-switch element.

In order to ensure that passengers can enter the delimited area only when said area is empty, it can be advantageously provided that the restrictor to enter the delimited area is opened only when the restrictor to exit from the delimited area is closed.

In order to ensure that no passengers improperly enter the loading area, it can be advantageously provided that the restrictor to exit from the delimited area is opened only when the restrictor to enter the delimited area is closed.

Within the scope of the invention, the term "opened" means mechanically opened as well as that passage is permitted by way of suitable, for example, optical signals. Within the scope of the invention, the term "closed" means mechanically closed as well as that passage is not permitted by way of suitable, for example, optical signals.

Within the scope of the invention, it is preferred when the restrictor to enter the delimited area is closed before its activation.

Within the scope of the invention, it is preferred when the restrictor to enter the delimited area is closed after the predefined number of passages has been reached, until the next activation by the sensor.

In one embodiment of the invention, it is provided that the controller of the restrictor to enter the delimited area comprises a counting device as well as a memory in which a predefined number of passengers for one vehicle is stored. It can therefore be ensured that the suitable number of passengers is or will be provided for each vehicle, whereby the safety in the loading area is increased.

Within the scope of the invention, it can be provided, in particular, that the passage by a predefined number of individual passengers through the restrictor to enter the delimited area is permitted before the vehicle has reached the loading area. It is therefore ensured that the desired number of passengers has gathered in the delimited area when the vehicle reaches the loading area.

In yet another preferred embodiment, it is provided that, after activation, a predefined number of passages by individual passengers, which corresponds to the maximum number of passengers permitted for the vehicle, through the restrictor to enter the delimited area is permitted.

Within the scope of the invention, for example, a first station and a second station, in particular a valley station and a mountain station, can be provided, wherein at least one intermediate station can also be provided. The aerial cableway systems or the stations can be situated not only in open areas, e.g., in ski resorts or recreational parks, but also in urban regions. Within the scope of the invention, the cable-drawn vehicles can be used in an aerial cableway system as well as a funicular system.

It is therefore possible that only the boarding by a number of passengers is possible in the first station, for example, wherein this number does not correspond to the maximum possible number of passengers per vehicle. It is therefore ensured that further passengers can board this vehicle in an intermediate station. If a car is intended for eight persons, for example, it can be ensured according to the invention that only four passengers can board the car in the first station, and therefore four further passengers can board this car in an intermediate station, or only, e.g., every second vehicle is occupied.

A display can be provided, on which the predefined number of passengers as well as the number of passengers currently located in the delimited area is displayed.

Within the scope of the invention, one or several, preferably two, person-separating systems situated next to each other can be provided as the restrictor to enter the delimited area, and can be activated in alternation, for example. Within the scope of the invention, two or more delimited areas situated next to each other can also be provided, which are activated in alternation, for example.

According to the invention, a method for operating an aerial cableway system as claimed can be provided. The features described with respect to the aerial cableway system can also be implemented as method features.

Further details, features and advantages of the invention result from the following description with reference to the attached drawings in which preferred embodiments are represented.

BRIEF DESCRIPTION OF THE SEVERAL VIEWS OF THE DRAWING

Therein.

DESCRIPTION OF THE INVENTION

Figure 1:
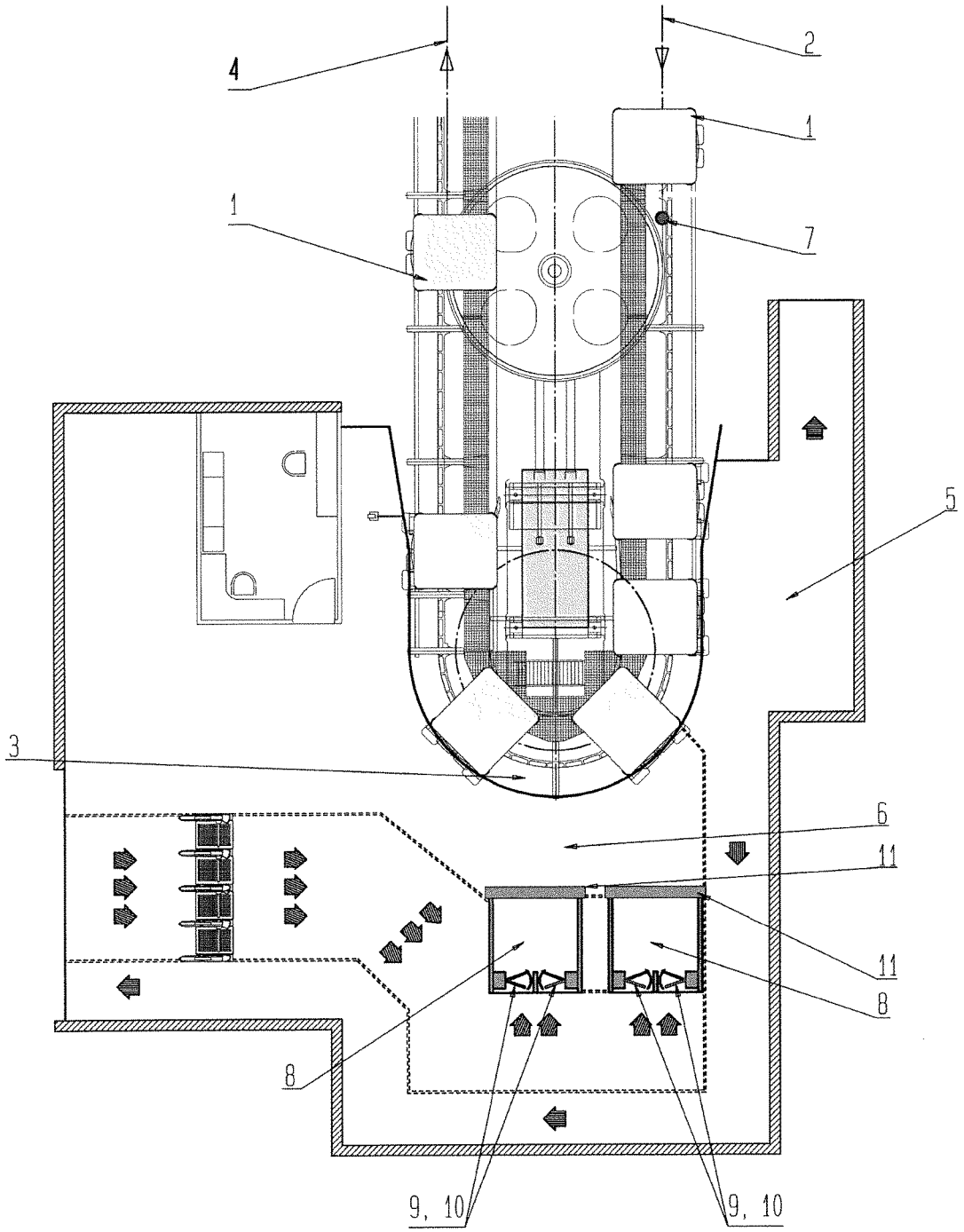
FIG. 1 shows an aerial cableway system according to the invention in the area of a station.
Figure 2:
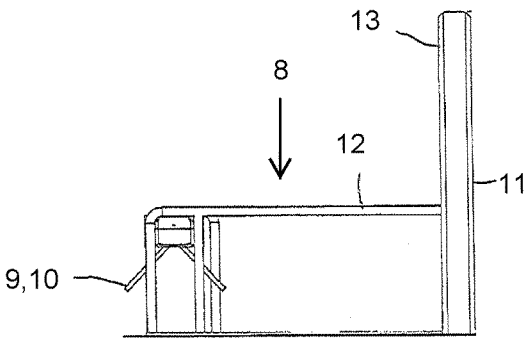
FIGS. 2 to 5 show a delimited area for passengers.
Figure 3:
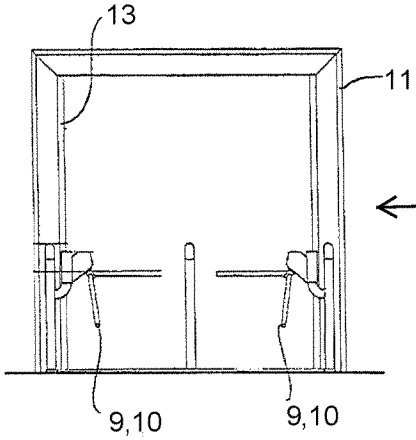
Figure 4:
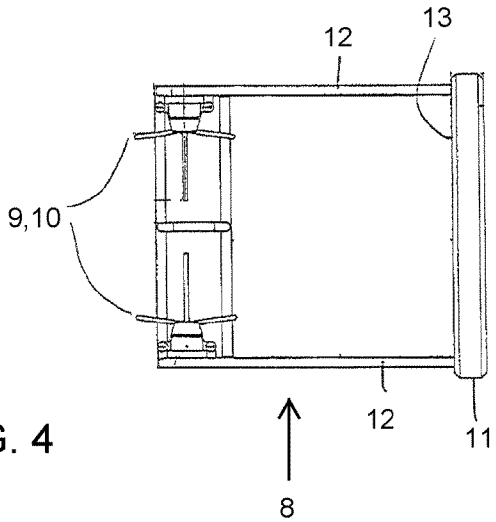
Figure 5:
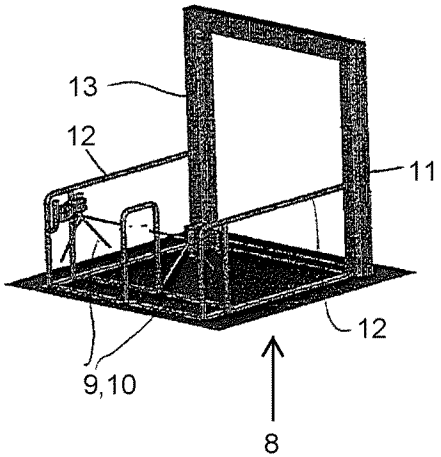

FIG. 1 shows an aerial cableway system in the area of a station, wherein the vehicles 1 are cars. The cars 1 and the guidance or the drive of the cars can be designed as is known from the prior art. The cars 1 enter the station in direction of travel 2, are redirected there in a redirection area 3, and exit the station in direction of travel 4. An unloading area 5 for the passengers is provided upstream from the redirection area 3. A loading area 6 for the passengers is provided in the redirection area 3.

A sensor 7, which is activated by a vehicle 1 entering the station, is situated upstream from the loading area 6, as viewed in direction of travel 2 of the vehicle 1, namely in the area in which a vehicle 1 enters the station, in the exemplary embodiment shown. Two delimited areas 8 for passengers are situated next to the loading area 6. In the access direction as viewed toward the vehicle, the delimited areas 8 each comprise a restrictor 9 to entry into the delimited area 8 in the form of two turnstiles 10 situated next to each other. The delimited areas 8 each comprise a second restrictor 11 to exit from the delimited area 8, a better view of said restrictors being provided in 2 to 5. The restrictor 11 to exit from the delimited area 8 is a passage provided with a traffic light system which comprises illuminated bars 13, wherein the color "red" means that the delimited area may not yet be exited, and the color "green" means that the delimited area may be exited. If necessary, the color "yellow" can be used, which can mean that the passengers may exit the delimited area soon. Barriers 12 are provided at the sides.

When a vehicle 1 entering the station activates the sensor 7, the sensor 7 activates a controller of the restrictor 11 to exit from the delimited area 8, whereby the restrictor 11 to exit from the delimited area 8 is opened after a certain period of time has passed, and displays color "green". Persons located in the delimited area 8 can now enter the loading area 6. While the restrictor 11 to exit from the delimited area 8 is open, the restrictor 9 to enter the delimited area 8 is closed in order to ensure that other passengers do not inadvertently enter the loading area 6.

After a further period of time has passed or if the passengers have exited the delimited area 8, the restrictor 11 to exit from the delimited area 8 closes again, wherein the color "red" is displayed and its controller opens the restrictor 9 to enter the delimited area 8. While the restrictor 9 to enter the delimited area 8 is open, the restrictor 11 to exit from the delimited area 8 is closed ("red").

A controller of the turnstiles comprises a counting device as well as a memory in which a predefined number of passengers for one vehicle 1 is stored. After activation of the turnstiles by the controller of the restrictor 11 to exit from the delimited area 8, a predefined number of individual passengers can enter the delimited area 8. When the predefined number of passengers has entered the delimited area 8, the turnstiles are blocked again until the next activation by the sensor 7. The persons located in the delimited area 8 remain in the delimited area 8 until a new vehicle 1 entering the station activates the sensor 7, which activates the controller of the restrictor 11 to exit from the delimited area 8, whereby the restrictor 11 to exit from the delimited area 8 is opened again ("green") after a certain period of time has passed.

In summary, an exemplary embodiment of the invention can be represented as follows:

An aerial cableway system comprises at least two stations between which vehicles 1, in particular cars, can travel as they are pulled by a cable, wherein the stations include a loading area 6 for passengers to board vehicles 1 and an unloading area 5 for passengers to deboard vehicles 1. A sensor 7 which is can be activated by a vehicle 1 entering a station. At least one delimited area 8 comprising at least one restrictor 9, 11, which includes a controller which can be activated by the sensor 7, is located in the station.

The invention claimed is:

1. An aerial cableway system, comprising:

at least two stations between which vehicles for transporting passengers are conveyed by cable;

said stations containing a loading area for passengers to board the vehicles and an unloading area for passengers to disembark;

a sensor disposed for activation by a vehicle entering a station;

at least one delimited area in the station;

at least one restrictor, including an exit restrictor to exit from said delimited area and an entry restrictor to enter said delimited area; and a controller for said at least one restrictor, said controller being activated by said sensor; and wherein said entry restrictor is opened only when said exit restrictor is closed.

2. The aerial cableway system according to claim 1, which comprises an information transmitter configured to activate said sensor, said information transmitter being carried on each of the vehicles or being disposed in the area of the station.

3. The aerial cableway system according to claim 1, wherein said sensor is disposed, in a direction of travel of the vehicles, upstream from the loading area.

4. The aerial cableway system according to claim 1, wherein said controller comprises a time-switch element, and said at least one restrictor permits passage by a predefined number of individual passengers after a predefined period of time following an activation of the sensor by a vehicle.

5. The aerial cableway system according to claim 4, wherein the period of time is variable in dependence on a current speed of the vehicles into and/or through the station.

6. The aerial cableway system according to claim 4, which further comprises a display for displaying the predefined number of passengers and a number of passengers currently located in said delimited area.

7. The aerial cableway system according to claim 1, wherein the delimited area is associated with the loading area and is located upstream from the loading area in an embarking direction by the passengers.

8. The aerial cableway system according to claim 1, wherein said entry restrictor is configured for selectively restricting access to said at least one delimited area and is disposed ahead of said delimited area in an access direction toward the vehicle.

9. The aerial cableway system according to claim 8, wherein said entry restrictor to enter the delimited area is a person-separating system.

10. The aerial cableway system according to claim 9, wherein said entry restrictor is a turnstile.

11. The aerial cableway system according to claim 8, wherein said entry restrictor to enter said delimited area is activated by one further sensor that is controlled by a vehicle entering said loading area or by one further time-switch element.

12. The aerial cableway system according to claim 8, wherein said controller of said entry restrictor to enter said delimited area comprises a counting device and a memory in which a predefined number of passengers for one vehicle is stored.

13. The aerial cableway system according to claim 12, wherein, after activation, a predefined number of passages by individual passengers through said entry restrictor to enter the delimited area is permitted.

14. The aerial cableway system according to claim 13, wherein said entry restrictor is closed after the predefined number of passages has been reached, until a next following activation.

15. The aerial cableway system according to claim 1, wherein said exit restrictor is a restrictor for restricting an exit from said delimited area in an access direction toward the vehicle.

16. The aerial cableway system according to claim 15, wherein said exit restrictor for controlling the exit from said delimited area is at least one of a mechanical barrier or a display device providing information regarding when the passengers are permitted to exit from said delimited area.

17. The aerial cableway system according to claim 16, wherein said exit restrictor comprises one or more of a display, a projector, or a passage provided with a traffic-light system.

18. The aerial cableway system according to claim 16, wherein said sensor is configured to activate a controller of said exit restrictor to exit from said delimited area, and said at least one restrictor further includes an entry restrictor to enter said delimited area and said entry restrictor is activated by said controller of said exit restrictor to exit from said delimited area.

19. The aerial cableway system according to claim 1, wherein said exit restrictor is opened only when said entry restrictor is closed.

20. An aerial cableway system, comprising:

at least two stations between which vehicles for transporting passengers are conveyed by cable;

said stations containing a loading area for passengers to board the vehicles and an unloading area for passengers to disembark;

a sensor disposed for activation by a vehicle entering a station;

at least one delimited area in the station;

at least one restrictor, including an exit restrictor to exit from said delimited area and an entry restrictor to enter said delimited area; and a controller for said at least one restrictor, said controller being activated by said sensor; and wherein said exit restrictor is opened only when said entry restrictor is closed.

21. An aerial cableway system, comprising:

at least two stations between which vehicles for transporting passengers are conveyed by cable;

said stations containing a loading area for passengers to board the vehicles and an unloading area for passengers to disembark;

a sensor disposed for activation by a vehicle entering a station;

at least one delimited area in the station;

at least one restrictor, including an exit restrictor to exit from said delimited area and an entry restrictor to enter said delimited area; and a controller for said at least one restrictor, said controller being activated by said sensor; and wherein said entry restrictor is opened only when said exit restrictor is closed and said exit restrictor is opened only when said entry restrictor is closed.

* * * * *